US006367645B1

(12) United States Patent
Trygg

(10) Patent No.: US 6,367,645 B1
(45) **Date of Patent: *Apr. 9, 2002**

(54) STACKABLE BOTTLE AND CARRIER PLATE FOR HANDLING AND EXPOSURE OF THE BOTTLE

(76) Inventor: Lars Erik Trygg, Box 243, S-374 24 Karlshamn (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,735

(22) PCT Filed: Jan. 31, 1997

(86) PCT No.: PCT/SE97/00154

§ 371 Date: Jul. 16, 1998

§ 102(e) Date: Jul. 16, 1998

(87) PCT Pub. No.: WO97/28061

PCT Pub. Date: Aug. 7, 1997

(51) Int. Cl.[7] ..... B65D 71/00

(52) U.S. Cl. ..... 220/513; 206/509; 217/21; 220/509; 220/516; 220/DIG. 2; 220/DIG. 15

(58) Field of Search ..... 220/513, 516, 220/517, 518, 519, DIG. 15, 630, 509, DIG. 2; 206/203, 508, 509, 518, 520, 821, 501; 217/26.5, 21; 229/904; 215/10

(56) References Cited

U.S. PATENT DOCUMENTS

| | | | | | |
|---|---|---|---|---|---|
| 827,124 | A | * | 7/1906 | Speer | 220/509 |
| 1,626,930 | A | * | 5/1927 | Grogg | 206/508 |
| 2,743,030 | A | * | 4/1956 | Read, Jr. | 220/510 |
| 2,997,199 | A | * | 8/1961 | Reachi | 220/630 X |
| 3,066,820 | A | * | 12/1962 | Faulstich | 215/305 X |
| 3,079,037 | A | * | 2/1963 | Schechter | 220/630 X |
| 3,162,327 | A | * | 12/1964 | Bennett | 206/520 X |
| 3,250,422 | A | * | 5/1966 | Parish | 220/23.83 |
| 3,485,355 | A | * | 12/1969 | Stewart | 206/509 |
| 3,632,015 | A | * | 1/1972 | Barth | 220/630 |

(List continued on next page.)

FOREIGN PATENT DOCUMENTS

| | | | | |
|---|---|---|---|---|
| DE | 34 43 423 | | 5/1986 | |
| DE | 43 37 510 | | 5/1995 | |
| EP | 99827 | * | 2/1984 | 206/203 X |
| FR | 2 248 982 | | 5/1975 | |
| GB | 943947 | * | 12/1963 | |
| GB | 2 182 304 | | 5/1987 | |
| WO | WO 96/09220 | | 3/1996 | |
| WO | WO 96/12657 | | 5/1996 | |

*Primary Examiner*—Lee Young
*Assistant Examiner*—Joseph C Merek
(74) *Attorney, Agent, or Firm*—Sughrue Mion, PLLC

(57) ABSTRACT

A bottle that can be stacked on other similar bottles (4), either with or without an intermediate carrier plate (1), is bound together with adjacent bottles to form stable stacks. The bottom surface of the bottle includes a cavity (15, 16, 18) adapted to receive at least a part of the capsule (12) of a bottle in an underlying layer. The cavity has at least one guiding and constraining surface (15) which coacts, with a tight fit, with a corresponding guiding and constraining surface of the capsule or with some other part of the bottle in the underlying layer, or with a corresponding guiding and constraining surface (11) of a bottle-guiding and constraining device (11, 13, 17) that projects up from a carrier plate positioned between the layers of bottles and in which there is received at least a part of the capsule of the bottle in the underlying layer. This provides stable lateral constraint of the upper part of a bottle in an underlying layer in the bottom of a bottle in an overlying layer, while the weight of the bottle in the top layer is transmitted to the bottle in the bottom layer. The invention also relates to a bottle fitting carrier plate.

23 Claims, 8 Drawing Sheets

U.S. PATENT DOCUMENTS 4,040,517 A * 8/1977 Torokvei ..... 220/519 X
4,042,108 A * 8/1977 Brethauer ..... 217/26.5 X
4,832,212 A * 5/1989 Askinazi ..... 206/503
4,848,573 A * 7/1989 Salcacuse ..... 206/427
4,911,300 A * 3/1990 Colonna ..... 206/427
4,923,723 A * 5/1990 Collette et al. ..... 215/12.1 X
5,038,961 A 8/1991 Watanabe et al.
5,244,106 A * 9/1993 Takacs ..... 215/373
5,316,173 A * 5/1994 Emery ..... 229/904 X

* cited by examiner

STACKABLE BOTTLE AND CARRIER PLATE FOR HANDLING AND EXPOSURE OF THE BOTTLE

The present invention relates to a bottle that can be stacked on other similar bottles either with or without an intermediate carrier plate and bound or interlocked with adjacent bottles to form stable stacks. The invention also relates to a carrier plate for handling and displaying such bottles.

Efforts are constantly being made in the brewery industry, among others, to devise more rational methods of increasing productivity. The customers, normally retailers, place demands on flexibility when ordering different items of goods and wish for the goods to be delivered in a manner which displays the goods to their customers in turn.

For instance, there is a general wish for bottles to be delivered in shallow trays or on plates which can be stacked one upon the other and in which the bottles can be clearly seen, instead of using deep crates. In this regard, it is also desired that stacks of mutually different sorts of beverages can be loaded onto a single pallet.

Bottles are, as a rule, handled in breweries in boxes or crates, therewith making it necessary to transfer the bottles onto suitable plates or trays for display. This constitutes an expensive procedure.

In order to facilitate handling stacks of present-day bottle trays, it is necessary to first place the stack on a small "slave pallet" and then place the slave pallet on a pallet of standard size. Among other things, this is necessary because the trays are so weak that a stack corresponding, for instance, to half the size of a standard pallet or to a third of the size of a pallet cannot be lifted solely by applying a lifting force to the bottom-most tray. Consequently, it is necessary to lift the stack with the aid of a separate stack-adapted slave pallet. Handling of such a stack in a brewery with the aid of a pallet trolley or the like is also problematic because of the instability of the stack.

There is described in my earlier PCT Application PCT/SE96/01466, a technique by means of which beverage-containing bottles can be handled in a rational, positive and very simple manner that does not require the bottles to be plucked from crates to trays, and vice versa, and which also enables a stack of trays and containers to be handled safely in a brewery, and facilitates loading a loading pallet with stacks that contain mutually different products. In order to achieve stable sideways constrainment of the bottoms of the bottles, the seats of the illustrated trays must be given relatively high walls and must fit well against the bottles.

WO 94/07758 and EP-A1-0 362 091 describe to other types of bottle trays that include seats in which the bottoms of the bottles are accommodated. These trays also require the use of high walls in order to achieve stable constrainment of the bottle bottoms. At least the solution described in the first-mentioned specification requires a relatively thick tray, since the trays must be capable of supporting the weights of all overlying bottles. Trays of this nature cannot be produced by vacuum-forming thin plastic plates, and are not suitable for one-time use only.

An object of the present invention is to provide a bottle, or flask, that can be stacked directly on other bottles with or without the use of intermediate trays or carrier plates, and which provides in either case stable sideways constrainment of both the upper parts of the bottles and their bottoms.

Another object of the invention is to provide a bottle-carrying plate which can be adapted for use when applying the aforesaid technique of lifting a stack of trays filled with bottles, and which will provide still more stable constrainment of the bottles standing on the plate, therewith providing very stable stacks even when stacking carrier plates that carry empty bottles.

A further object of the invention is to design the plates and bottles so that said plates can be produced from a material of such thinness as to enable them to be made from the same plastic material as the bottles with good economy, for instance from recoverable PET, which is very difficult to injection-mould. In addition to practical advantages relating to the handling of returned bottles and plates, it has been observed that a very high degree of friction is generated between a plate and a bottle that are both made of PET. Thus, it will preferably be possible to manufacture the carrier plate by vacuum-forming processes, preferably from a plastic sheet or foil that is so thin as to enable it to be used viably as a disposable article.

The invention is based on the realization that bottles, and then particularly bottles whose lower parts are inclined inwardly, cannot be supported stably without great difficulty when using solely an external constraining means, unless such means is made relatively high. Stability is greatly increased when there is also used a constraining means that projects into the bottle. It is also possible to exclude the outer constraining means completely, when using such an inner constraining means.

Accordingly, the particular characteristics of a bottle of the kind defined in the first paragraph are that the bottom surface of the bottle includes a cavity which is intended to receive at least a part of the capsule of a bottle in an underlying layer, wherein the cavity has at least one constraining guide surface that coacts with a corresponding guiding or constraining surface of the capsule or some other part of the bottle in the underlying layer or a corresponding guiding or constraining surface of a constraining means that projects up from a carrier plate located between the layers of bottles, with a tight fit, and in which constraining means at least a part of the capsule of the bottle in the underlying layer will fit such as to provide stable lateral constrainment of the upper part of a bottle in an underlying layer in the bottom of a bottle in a overlying layer while the weight of the bottle in the upper layer is transferred to the bottle in the bottom layer.

Bottles of this kind can be stacked directly on top of one another, wherein in the case of high stacks the bottles in mutually adjacent stacks are bound together in each third-fifth layer. This enables stable bottle stacks to be constructed with a desired number of bottles in each layer or tier.

The cavity will conveniently have a generally vertical inner cylindrical constraining surface adapted for coaction with the capsule of a bottle in an underlying layer, or with a part of a constraining means that projects up from a carrier plate and closely embraces the capsule.

It is preferred that this constraining surface will combine with a generally horizontal support surface that is intended to coact with a corresponding support surface on the capsule or on said constraining means. The bottle support surface is preferably ring-shaped and located immediately beneath an outer part of the bottle capsule.

An inventive carrier plate that is intended for handling and displaying bottles of this kind and constructed to enable several plates upon which bottles are placed to be stacked one upon the other is particularly characterized in that the plate is provided at each bottle position with an upstanding constraining means which mates with a corresponding cavity in the bottom of a bottle standing on the carrier plate such as to constrain the lower part of the bottle against lateral movement, and that the constraining means has a configuration which enables it to receive at least a part of the capsule of a bottle in an underlying layer such as to constrain lateral movement of the upper part of said bottle.

As before mentioned, the carrier plates can be vacuum-formed. When stacking bottle-carrying plates on top of one another, the bottles in each layer will be forcibly constrained at both their upper and their lower ends, so as to form a very stable stack.

It is preferred that the upstanding constraining elements have the form of downwardly open dome-shaped parts in which the capsules-of the bottles in an underlying layer will be received firmly, so as to be constrained against lateral movement. In this regard, the dome-shaped parts will suitably have a generally vertical inner cylindrical constraining surface adapted for coaction with the capsule of a bottle in an underlying layer.

It is also preferred that the dome-shaped parts have a generally horizontal inner stop surface for coaction with the capsules of the bottles in an underlying layer, wherein the stop surface forms a support surface for bottles standing on the carrier plate, and wherein the weight of bottles standing on the plate is transferable to bottles in an underlying layer via said support surface without subjecting the plate in general to any appreciable load.

Since the weights are transferred from bottle to bottle in each stack without unduly loading the plate, and since the bottles are constrained one within the other, the plate can be made of very thin material and at low cost.

The support surface is preferably ring-shaped and is located above an outer ring-shaped part of the capsule of an underlying bottle. That part of each dome-shaped part that lies radially within said ring-shaped support surface can therewith have an upwardly projecting part adapted to be received in a corresponding cavity in the bottom of an overlying bottle.

This further improves constrainment of the bottles. Furthermore, the presence of such an upwardly projecting part prevents bottles from being placed on the plate that are not intended for use together with the plate.

Further characteristic features of the carrier plate will be evident from the dependent Claims directed thereto.

The carrier plate and the bottle can both be produced conveniently from a recoverable plastic material, preferably PET, wherein waste plates and bottles can be ground together in the brewery and re-shaped into thin plastic sheets from which new inventive carrier plates can be vacuum-formed. This eliminates all transportation of empty carrier plates from a plastic industry to the brewery.

The invention will now be described in more detail with reference to exemplifying embodiments thereof and also with reference to the accompanying drawings.

Figure 1:
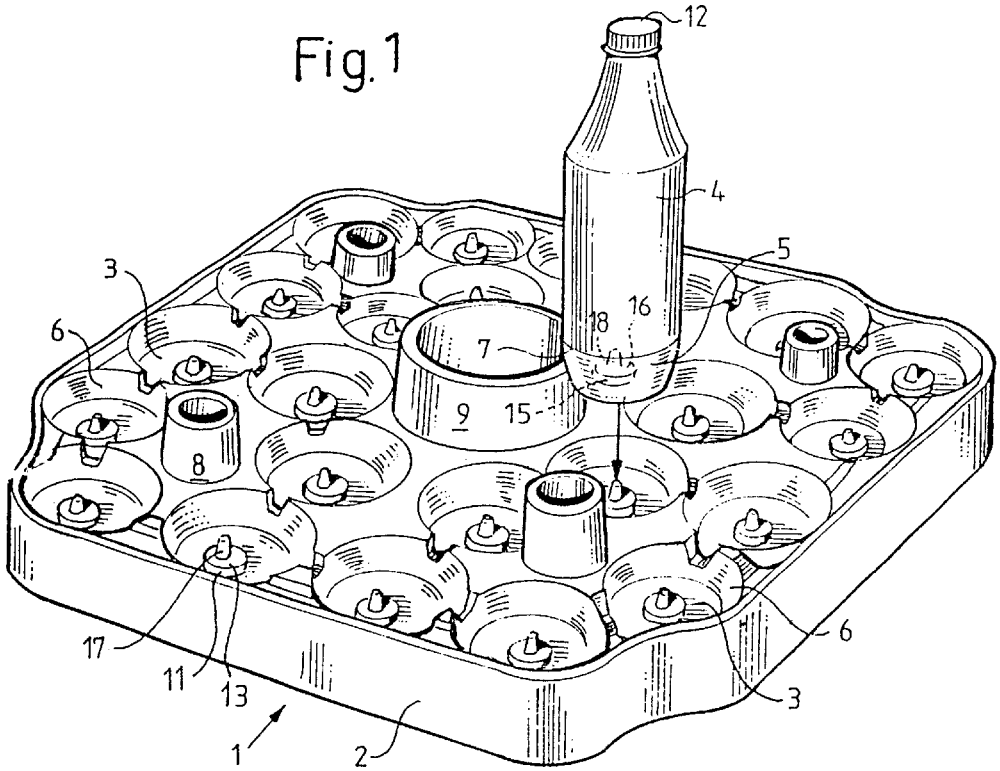
FIG. 1 illustrates a first embodiment of an inventive carrier plate and a bottle intended for use therewith.

FIG. 1 illustrates an inventive carrier plate 1 which is vacuum-formed from a thin sheet or foil of recoverable plastic material, preferably PET. The carrier plate will have a typical thickness of 1–1.5 mm. The plate includes a peripherally extending, downwardly folded supporting skirt 2 and cup-shaped impressions that form seats 3 for bottles 4. In the illustrated embodiment, the bottles 4 have an inwardly sloping lower part 5 and the seats 3 have slightly conical walls 6 such as to fit accurately around said lower part 5. The fit between bottles and seats may be of such a fine nature as to obtain a snap-in effect through the medium of a slight shoulder 7 on the bottles and the upper defining edge of respective seats.

The reference numeral 8 identifies four lead-throughs or holes which are uniformly spaced with respect to the weight of the plate 1 and which are intended for use in lifting operations. The reference numeral 9 identifies a large central lead-through or hole which can also be used in lifting operations, particularly when empty carrier plates are stacked in one another.

Figure 2:
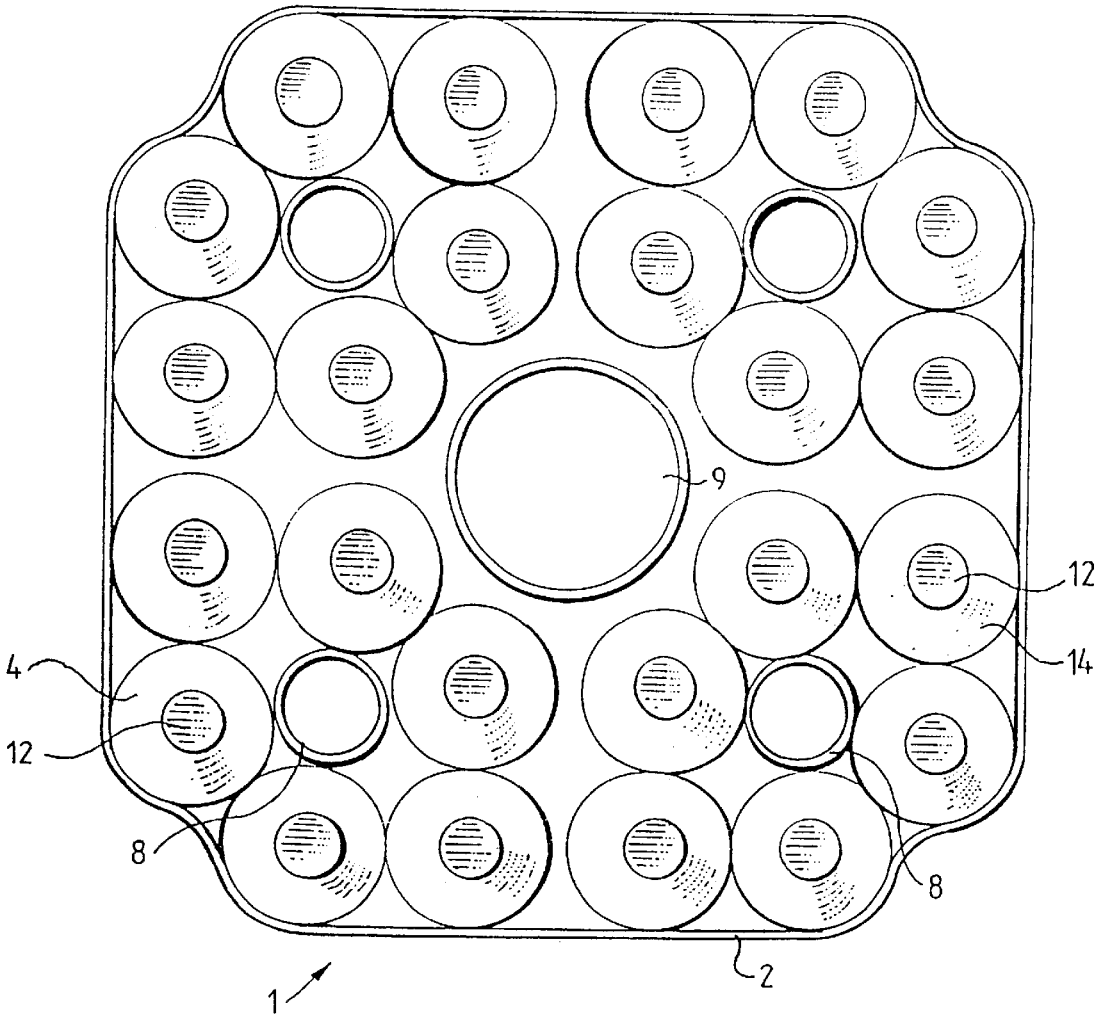
FIG. 2 is a horizontal view of a FIG. 1 carrier plate filled with bottles.

FIG. 2 illustrates the manner in which the positions of the bottles 4 are distributed over the plate. A grouping of six bottles is found around each lifting hole 8, wherein the bottles can be interlocked with a suitable carrying handle and lifted up from the plate in the form of a unit that can be handled easily by the consumer. The dimensions of the plate are chosen so to form a module that together with a plurality of similar modules will completely fill a standard pallet. The plate of-the illustrated embodiment measures externally 400×400 mm and is intended to accommodate twenty-four bottles each having a diameter of about 70 mm.

Provided in the centre of the bottom surface of each seat 3 is an upstanding bottle guiding and constraining means that is intended to coact with a corresponding cavity in the bottom of the bottle 4 such as to positively constrain the bottle against lateral movement.

Figure 3:
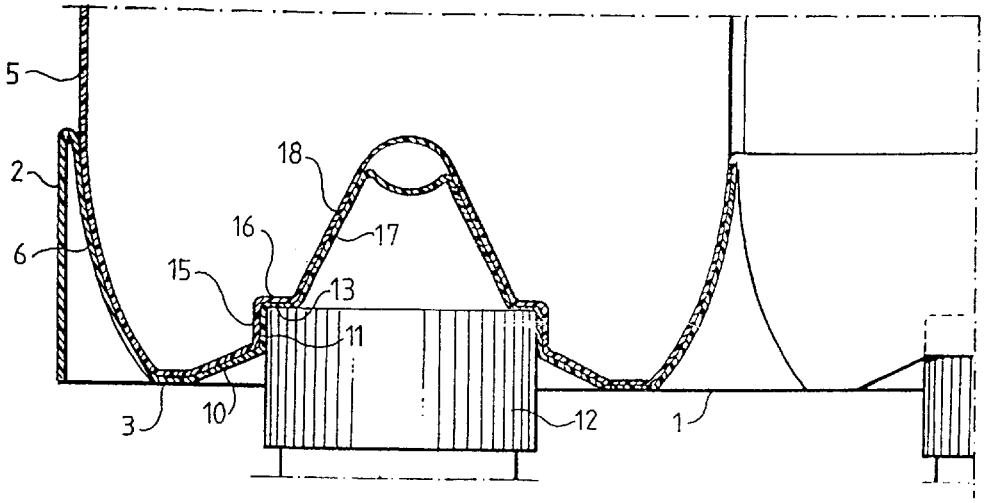
FIG. 3 is a part-sectional view of the lower part of a bottle and an associated part of the plate, and illustrates the coaction between bottle and plate.

FIGS. 1 and 3 illustrate a first embodiment of the constraining means upstanding from the plate. The constraining means has the form of a downwardly open dome-shaped part that includes a conical portion 10 which functions to guide-in the bottle and which merges with a generally circular-cylindrical portion that includes a generally vertical, cylindrical constraining surface 11. This constraining surface is adapted to receive and constrain the upper part of the capsule 12 of a bottle 4 in an underlying layer with a fine fit, when carrier plates that carry bottles are stacked one upon the other. The constraining surface 11 merges with a capsule stop surface 13, said stop surface also forming a surface for supporting the bottom part 5 of a bottle 4 placed in the seat.

The bottom surface of the bottom part 5 of the bottle includes an inner cavity which is intended to receive the dome-shaped constraining means upstanding from the plate 1, and has a configuration that generally conforms to the configuration of the plate-mounted constraining means. The cavity in the bottom of the bottle thus has a generally vertical cylindrical wall 15 which coacts with the wall-part 11 of the guiding and constraining means, and a ring-shaped support surface 16 which coacts with the support surface 13 on the constraining and guiding means..

In the illustrated embodiment, the guiding and constraining means and the bottle cavity have respectively a conical part 17 and 18 that projects up inwardly of respective guiding and constraining surfaces 13 and 16.

The fit between the guiding and constraining means upstanding from the carrier plate and the cavity in the bottom of the bottle is suitably such that when a bottle is placed down Into a bottle seat, the conical parts 17 and 18 will not come into contact with one another until, e.g., the distance between the side surfaces 16 and 13 is only one or more tenths of a millimeter. The conical part 17 of the guiding and constraining means is then pressed slightly inwards as the lower part 5 of the bottle is pressed down, until said support surfaces come into contact with one another. The bottom part 5 of the bottle will therewith be constrained against lateral movement very stably in its seat in the plate 1, at the same time as the bottle 4 in an underlying layer is firmly constrained in the dome-like constraining means as a result of the coaction of the capsule 12 with the constraining surface 11, which, in turn, is supported by corresponding surface 15 of the cavity in the bottom of the bottle. The bottles in a stack of carrier plates that carry bottles are thus constrained by their mutual interaction, thereby providing a very stable stack.

The gravitational forces that must be transferred between the various layers in a stack will be transmitted from bottle to bottle through the agency of the combined stop and support surface 13, without subjecting the plate 1 in general to any appreciable load. Thus, the weight of a bottle in an upper layer Is transmitted to the capsule 12 of a corresponding bottle in an underlying layer via the support surface 16 of the bottle and the support surface 13 of the guiding and constraining means, and so on. This is illustrated schematically in FIG. 4.

Figure 4:
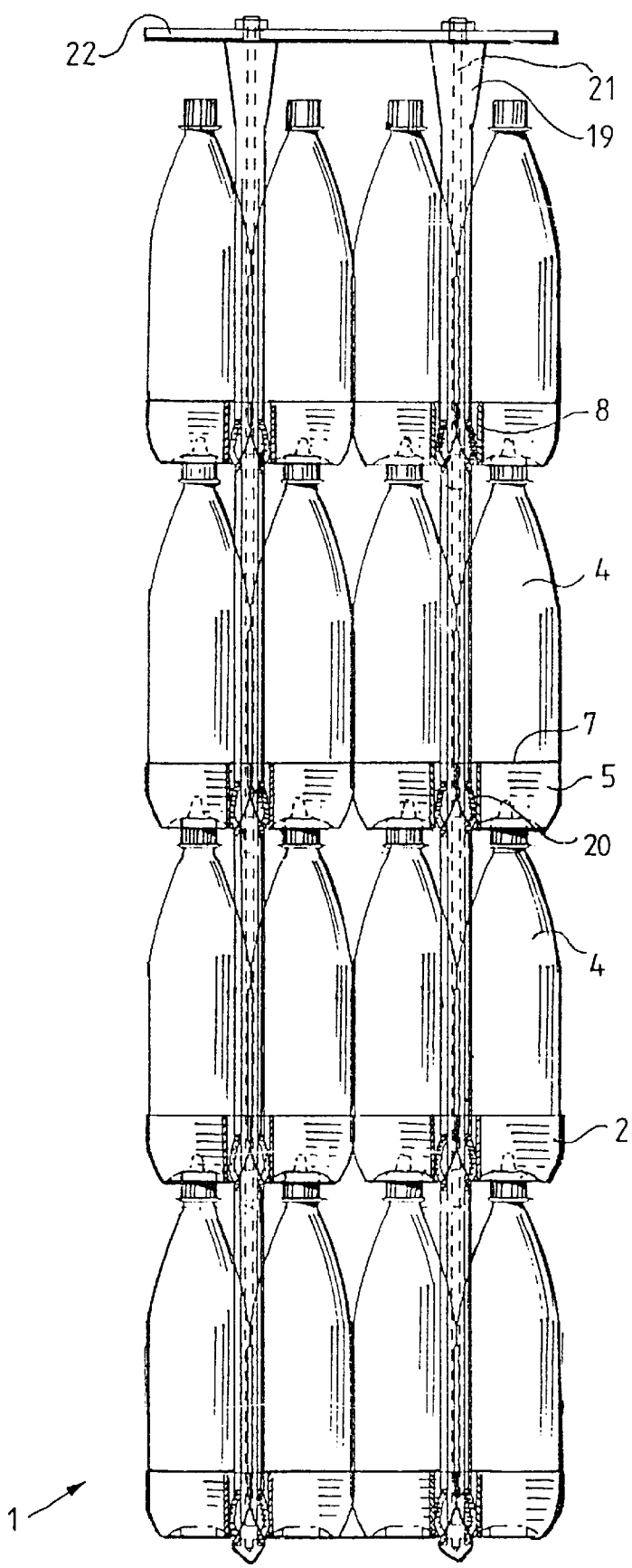
FIG. 4 illustrates how inventive carrier plates filled with bottles can be stacked one upon the other, and also illustrates the principle according to which such a stack is lifted.

FIG. 4 shows four carrier plates 1 with bottles 4 stacked on top of one another, wherein the plates and the bottles are designed to constrain and guide one another in accordance with the principle illustrated in FIG. 3. Such a stack will be very stable as a result of the mutual constraining effect of the bottles. In addition, the plates 1 will not be subjected to the weights of the various bottles since the weights of the bottles is transmitted vertically in the stack from bottle to bottle.

When handling a stack in a brewery for instance, a rod-like lifting device 19 is passed down through each hole 8 in the various plates 1. The rod 19 is provided with grippers 20 at the position of each hole 8 for coaction with respective plates. In the illustrated embodiment, these grippers have the form of rubber cuffs 20 that can be expanded by delivering compressed air thereto via an inner passageway 21. When expanded, the rubber cuffs engage the walls of respective holes 8 so as to enable the entire stack to be lifted with the aid of a lifting force applied to a carrier 22.

An important advantage with this lifting principle is that a lifting force is applied separately to each plate 1 and consequently the bottom plate will not be subjected to more load than any of the other plates. This enables a high stack to be lifted and handled without using a slave pallet or the like underneath the stack.

Of course, the lifting principle can also be applied to lift each individual plate 1 in handling and stacking the plates.

In this case, there are used short lifting devices 19 whose length correspond solely to the height of a bottle.

The lifting devices may also be provided with other types of grippers for coaction with respective plates. This lifting principle and suitable lifting devices for use when applying the principle are described in more detail in my earlier Swedish Patent Application No. 9504068-9, to which reference is now made. The lifting device will not be described in further detail in this document.

Figure 5:
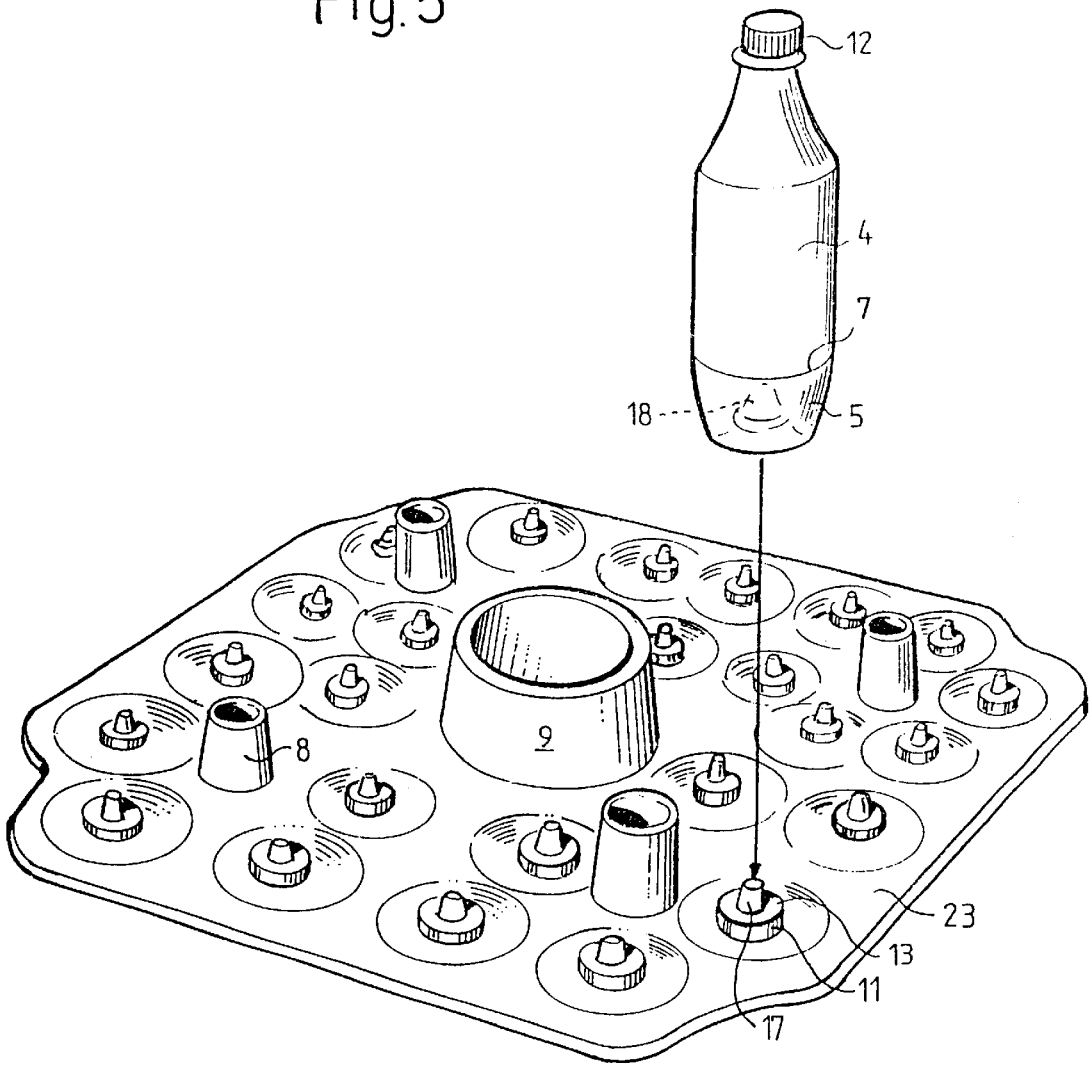
FIG. 5 illustrates a second embodiment of an inventive carrier plate.

As a result of the extremely stable constrainment of each bottle achieved by the constraining and guiding means that projects into the bottle, it is also possible to construct inventive carrier plates with no external constrainment of respective bottles. FIG. 5 illustrates an embodiment of one such plate. The embodiment illustrated in FIG. 5 includes a generally flat plate 23 from which there project dome-shaped guiding and constraining means of the same design as those shown in FIG. 3. The bottle 4 also corresponds to the earlier described bottle. This embodiment further simplifies manufacture of the plate and lowers the cost of such manufacture. The plate cannot be stretched or compressed in its plane and the bottle constraining and guiding means will therefore be maintained in a constant position, therewith further improving the stability of a stack.

Figure 6:
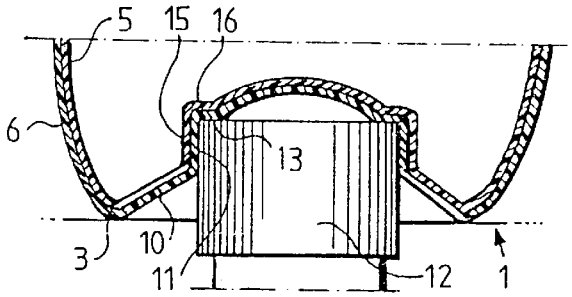
FIG. 6 is a part-sectional view corresponding to FIG. 3 and illustrating a modified version of the plate and bottle constraining means.

FIG. 6 is a sectional view corresponding to FIG. 3 and illustrates an alternative embodiment of the upstanding bottle constraining and guiding means and the corresponding cavity in the bottle part 5 of the bottle. This embodiment differs from the earlier embodiment insomuch that the conical parts 17 and 18 of the constraining means and of the cavity respectively have been excluded since a sufficiently effective bottle-guiding and bottle-constraining effect is achieved solely by the coaction between the constraining surfaces 11 and 15.

A further advantage with the earlier embodiment illustrated in FIG. 3 in which a pronounced upstanding part is provided in the centre of each bottle seat is that "foreign" bottles that are not intended for use together with an inventive plate cannot be placed on the plate. This simplifies handling of returned bottles and carrier plates, since it can be ensured that only original products are returned.

The carrier plates and the bottles are preferably manufactured from a recoverable plastic material, preferably PET. Trials carried out with the invention have shown that greater bottle stability is achieved when bottles and carrier plates are both produced from PET, because the friction between two articles made of PET is very high, substantially higher than the friction between a bottle made of PET and a plate made of polyethylene for instance.

Because the plate can be vacuum-formed and because the bottles are constrained and the weight of the bottles is transferred from bottle to bottle, the plate can be made of material of such thinness as to render the use of PET for the plate economically viable.

This enables, for instance, both bottles and plates to be ground together in the brewery when they are returned and shaped into a thin sheet or foil from which new plates can be vacuum-formed. Although vacuum-forming is preferred, an inventive plate may, of course, be injection-moulded if so desired.

Because the inventive plates have a very small height or thickness and can be made fully transparent, they can be used to display beverage-containing bottles in retail stores in stacks and in a very attractive manner. Stacks of carrier plates that are laden with bottles in accordance with the invention can be stabilized by pressing an empty carrier plate down over a number of the uppermost bottles in four juxtaposed stacks, so as to bind the stacks together.

Because the bottles in different layers are precisely constrained and guided, there will be obtained a stable stack, even when stacking together carrier plates that carry empty bottles.

If desired, the two mutually coacting cones 17 and 18 in the FIG. 3 embodiment may be configured to obtain a snap-locking effect therebetween. Furthermore, if considered expedient because of the carbon dioxide pressure in the bottles, the cone 18 in the bottom of the bottle may be provided with radially extending or axially extending stiffening grooves.

It may also be suitable to provide the cone 17 and the constraining surface 11 in the plate with longitudinally extending pleats or grooves. This would stiffen the cone and allow air to enter between the mutually contacting surfaces of the constraining means and the cavity in the bottle when the bottle is lifted, therewith preventing the bottle from being held by vacuum forces. Because the pleats are deformable, they will also enhance the desired tight fit between the mutually contacting surfaces.

Figure 7:
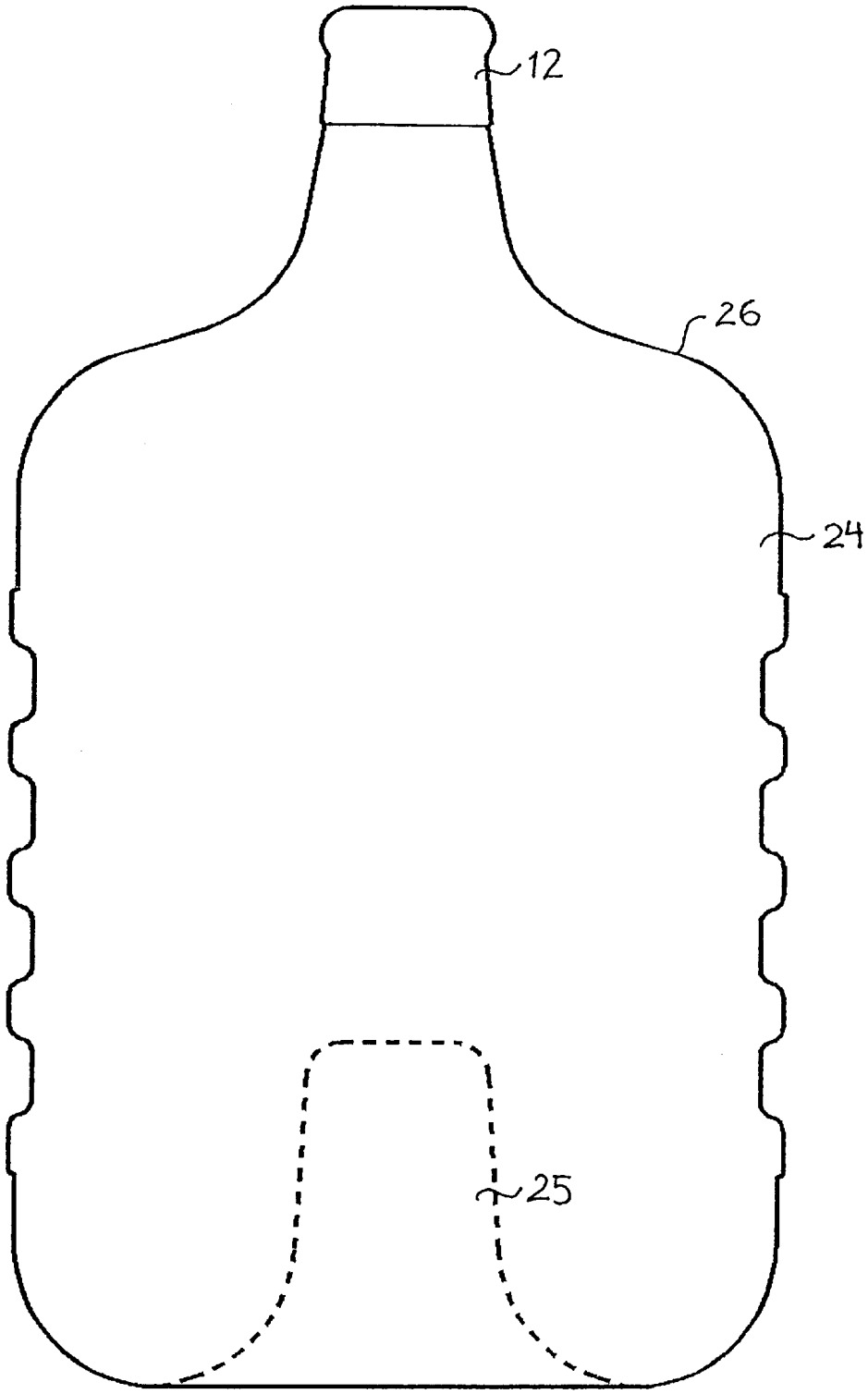
FIG. 7 illustrates an alternative embodiment of an inventive bottle.
Figure 8:
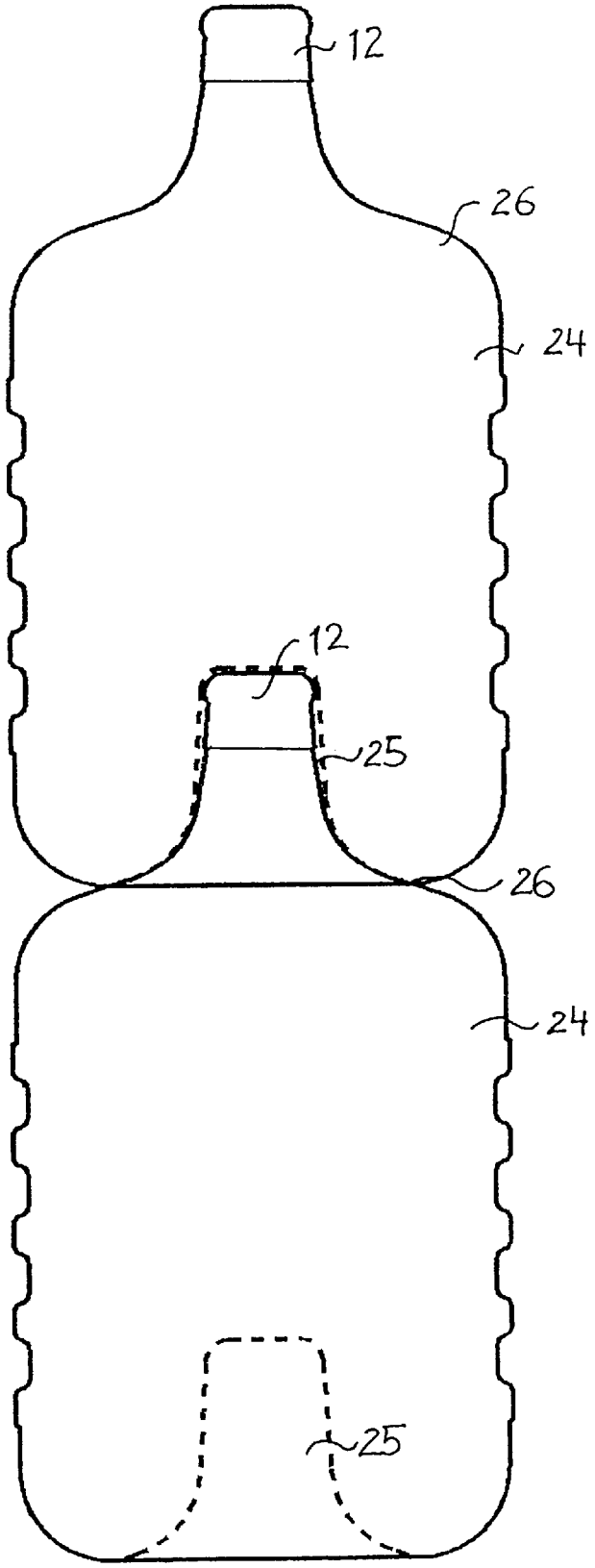
FIG. 8 illustrates two bottles according to FIG. 7 stacked one upon the other in the absence of an intermediate carrier plate.

FIG. 7 illustrates a variant of a bottle 24 according to the present invention. The depth of the cavity 25 in the bottom of the bottle (see FIG. 8) is such as to enable it to accommodate the whole of the capsule 12 and the neck of an underlying bottle 24. In this case, the bottom of an overlying bottle will rest on the shoulders 26 of the underlying bottle.

The weight of an overlying bottle will therefore be transferred to the underlying bottle with no load or only a low load on the capsule 12, which is an advantage in the case of some types of capsules that are sensitive to external pressures. A gain in stacking height is also achieved with bottles of this design, therewith enabling more bottles to be stacked on top of one another without increasing the total height of the stack.

Figure 9:
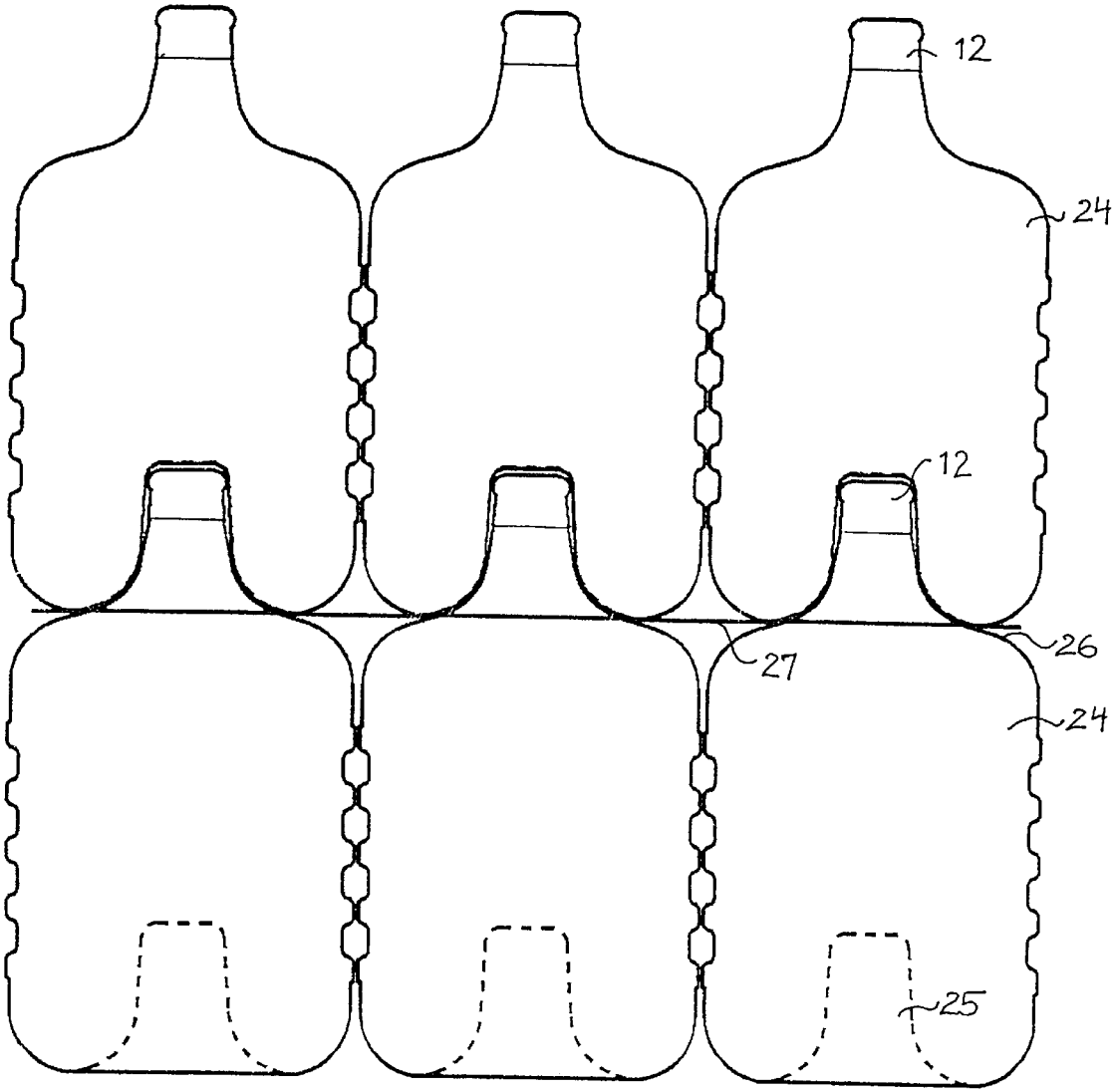
FIG. 9 shows how stacks of bottles according to FIG. 8 can be mutually bound together.

When the capsule 12 and the neck of an underlying bottle 24 protrude relatively far into an overlying bottle, a stable constrainment is obtained between the bottles in a bottle stack without using intermediate carrier plates. When building high stacks, however, the individual bottle stacks will preferably be bound together or interlocked in each third to fifth layer. As illustrated in FIG. 9, this can readily be achieved by threading over the bottles in desired layers a paperboard or plastic sheet 27 that includes holes for receiving the necks of respective bottles 24. In the case of low stacks, it may be sufficient to place such a sheet over the necks of the bottles in the top layer. Layer binding devices other than sheets may be used, of course, such as net-like structures.

Figure 10:
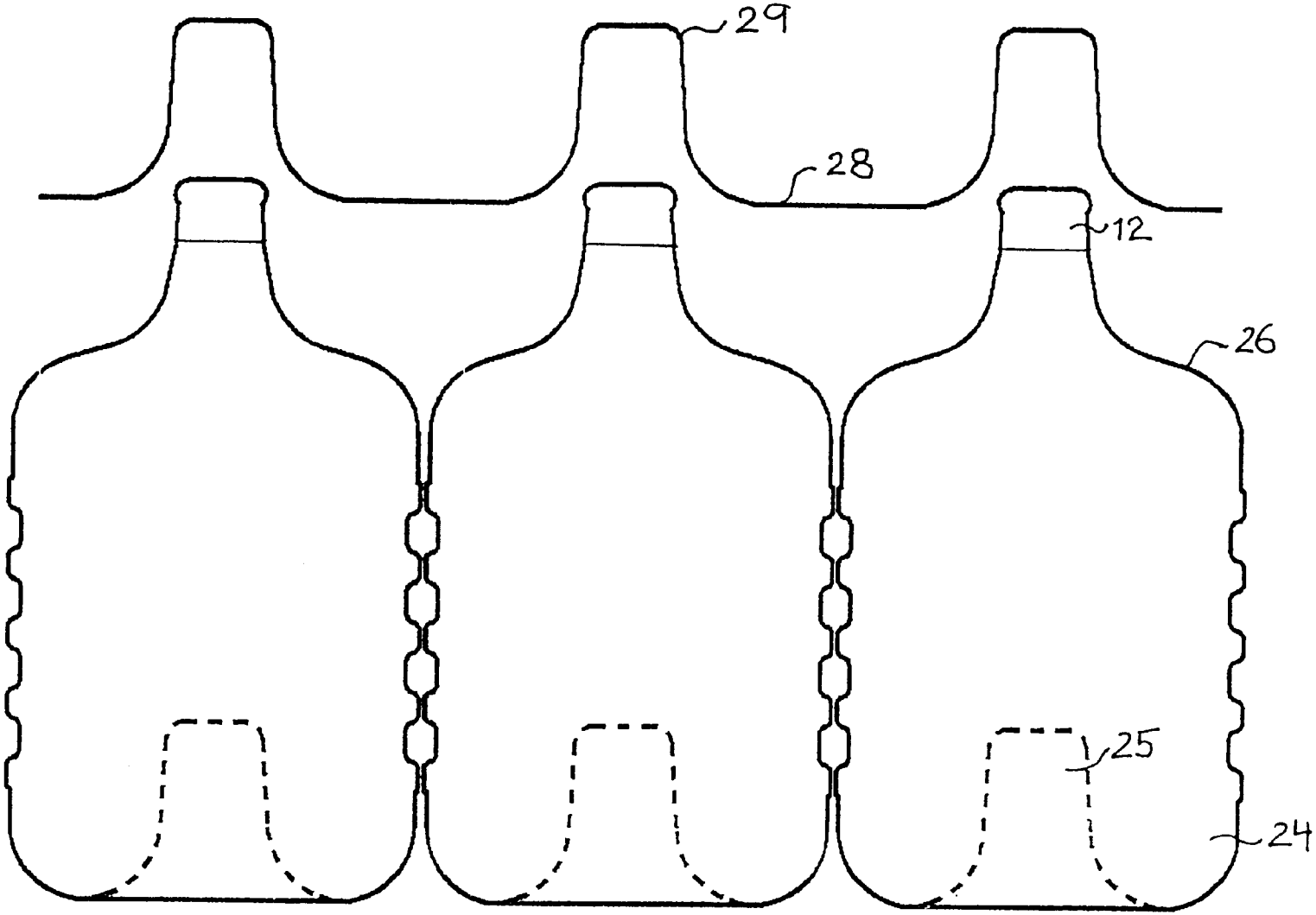
FIG. 10 illustrates the use of an alternative embodiment of a carrier plate with bottles according to FIG. 7.

As illustrated in FIG. 10, the sheets 27 shown in FIG. 9 may be replaced with tray-like plates 28 provided with upstanding bottle-guiding and constraining means 29 into which the capsules and necks of bottles 24 fit. In this case, the trays 28 are supported by the shoulders 26 of respective bottles. The guiding and constraining means 29 may, of course, be open upwardly.

In the case of bottles that have no pronounced shoulder parts, an overlying bottle may engage the sloping neck part of an underlying bottle either with or without an intermediate carrier plate 28, this embodiment being highly effective in constraining bottles against lateral movement.

Although the invention has been described with reference to illustrated exemplifying embodiments thereof, it will be understood that modifications and changes can be made within the scope of the following Claims. For instance, the invention can be applied with bottles of other shapes, wherewith the bottle seat in the plate will be adapted accordingly. The configuration of the bottle guiding and constraining means and corresponding cavities in the bottles may also be varied in different respects without departing from the inventive concept. It is, of course, possible to solely constrain lateral movement of the upper part of the capsule of a bottle in a cavity or recess in the bottom of an overlying bottle having the form shown in FIG. 3 or FIG. 6 in the absence of an, intermediate carrier plate. The bottles and carrier plates may also be made of any desired material.

What is claimed is:

1. A combination carrier plate and stack of bottles, comprising:

a plurality of upper bottles stacked on top of a plurality of lower bottles of similar construction; and a carrier plate disposed between said upper bottles and said lower bottles, said carrier plate interlocking adjacent upper bottles and adjacent lower bottles to stabilize said stack of bottles, wherein each of said upper and lower bottles comprises a cavity formed in a bottom part of said bottle and a capsule at an upper part of said bottle, wherein for each upper bottle said cavity accommodates at least a part of said capsule in a corresponding one of said lower bottles positioned directly below said upper bottle;

said carrier plate comprises means for guiding and constraining said upper and lower bottles, said means for guiding and constraining said upper and lower bottles projecting up from said carrier plate;

said cavity for each of said upper bottles has at least one vertical inner cylindrical guiding and constraining surface which coacts with a corresponding vertical guiding and constraining surface (11) of said means for guiding and constraining said upper and lower bottles (11, 13, 17; 29), wherein the coacting vertical guiding and constraining surfaces fit tightly together; and wherein at least a part of a vertical guiding and constraining surface on the capsule (12) of each of said bottles in the underlying layer fits into the corresponding vertical guiding and constraining surface of said means for guiding and constraining said upper and lower bottles (11, 13, 17; 29) to achieve stable constrainment against lateral movement of the upper part of said bottle (4; 24) in the underlying layer; and wherein the vertical guiding and constraining surface (15) of the cavity merges with a horizontal support surface (16) which coacts with a corresponding support surface (13) on said means for guiding and constraining said upper and lower bottles, so that a weight of each bottle in the top layer is transferred to the corresponding bottle in the bottom layer via the support surfaces of the cavity and the capsule, respectively, without subjecting shoulders of the bottle in the bottom layer to any direct load; and wherein said carrier plate includes a seat for each upper bottle, said seat having a wall that fits accurately around an outer part of the bottom part of the upper bottle so as to obtain a tight fit, and wherein said means for guiding and constraining said upper and lower bottles is disposed in said seat.

2. The combination carrier plate and stack of bottles according to claim 1, characterized in that the horizontal support surface (16) for each upper bottle is ring-shaped and located immediately above the corresponding lower bottle capsule (12).

3. The combination carrier plate and stack of bottles according to claim 2, characterized in that the cavity in the bottom of each of the lower and upper bottles (4) has a conical top (18) which is surrounded by the ring-shaped support surface (16).

4. The combination carrier plate and stack of bottles according to claim 1, characterized in that each of the upper and lower bottles is manufactured from a recoverable plastic material, preferably PET.

5. A carrier plate for handling and displaying beverage-containing bottles, wherein the plate (1; 23; 28) is constructed to enable a plurality of bottle-carrying plates to be stacked one upon the other, characterized in that the plate (1; 23; 28) includes at each bottle (4; 24) position an upstanding bottle guiding and constraining means (11, 13, 17; 29) for mating with a corresponding cavity (15, 16, 18; 25) in a bottom of a corresponding bottle standing on the plate and for constraining a lower part of the bottle against lateral movement; and in that the guiding and constraining means comprises a downwardly open dome-shaped part to receive at least a part of a capsule (12) of a corresponding bottle (4; 24) in an underlying layer such as to constrain an upper part of the bottle in the underlying layer against lateral movement; and wherein said dome-shaped part has a vertical inner guiding and constraining surface adapted for coaction with a vertical surface of the capsule of the bottle in the underlying layer, and a horizontal inner stop surface for engagement with a horizontal surface of the capsule of the bottle in the underlying layer, the stop surface being a support surface for the bottle standing on the plate so that a weight of the bottle standing on the plate is transferable to the bottle in the underlying layer via said support surface without subjecting the plate to an appreciable load.

6. A carrier plate according to claim 5, characterized in that the support surface (13) is ring-shape and located above an outer ring-shaped part of the capsule 12 on the underlying bottle (4).

7. A carrier plate according to claim 6, characterized in that the part of each dome-shaped portion that is located inwardly of the ring-shaped support surface (13) has an upstanding part (17) adapted to be received in the corresponding cavity (18) in the bottom of (4) standing on the plate.

8. A carrier plate according to claim 7, characterized in that the upstanding part (17) is conical and adapted to coact with the cavity (18) in the bottom of the bottle (4) standing on the plate and which cavity is also conical in shape.

9. A carrier plate according to claim 8, characterized in that the fit between the conical parts (17, 18) is such that when placing the bottle (4) on the carrier plate (1), said parts will make contact with each other before the bottom (16) of the bottle (4) on the carrier plate has reached contact with said support surface (13).

10. A carrier plate according to claim 5, characterized in that the carrier plate includes for each bottle (4) on the carrier plate a bottle seat (3) that includes a wall (6) which at least partially surrounds the lower part (5) of the bottle (4); and in that said upstanding guiding and constraining means is disposed centrally in each seat.

11. A carrier plate according to claim 10, characterized in that the plate includes a plurality of holes (8; 9) disposed between the seats (3) and adapted for coaction with lifting devices (19, 20) insertable into said holes.

12. A carrier plate according to claim 11, characterized in that the holes (8; 9) are through-penetrating holes and are uniformly distributed in the plate (1; 23) from the aspect of plate equilibrium, so as to enable a stack of mutually stacked bottle-carrying plates to be lifted with the aid of lifting devices (19, 20) that are insertable through the holes (8) in the plates in said stack and adapted to engage respective plates.

13. A carrier plate according to claim 5, characterized in that the plate is vacuum-formed from a thin sheet or film of recoverable plastic, preferably PET.

14. A combination carrier plate and stack of bottles, comprising:

a plurality of upper bottles stacked on top of a plurality of lower bottles of similar construction; and a carrier plate disposed between said upper bottles and said lower bottles, said carrier plate interlocking adjacent upper bottles and adjacent lower bottles to stabilize said stack of bottles; wherein each of said upper and lower bottles comprises a cavity formed in a bottom part of said bottle and a capsule at an upper part of said bottle, wherein for each upper bottle said cavity accommodates at least a part of said capsule in a corresponding one of said lower bottles positioned directly below said upper bottle;

said carrier plate comprises guides corresponding to said upper and lower bottles that constrain said upper and lower bottles, said guides projecting up from said carrier plate, said guides including vertical guiding and constraining surfaces;

said cavity for each of said upper has at least one vertical inner cylindrical guiding and constraining surface which coacts with said corresponding vertical guiding and constraining surfaces of said guides, wherein the coating vertical guiding and constraining surfaces fit tightly together; and wherein said plate includes a seat for each of said upper bottles, said seat having a wall that fits accurately around an outer part of the bottom part of the upper bottle so as to obtain a tight fit, and wherein each of said guides is disposed in a corresponding one of said seats.

15. The combination carrier plate and stack of bottles according to claim 14, wherein said cavity for each of said upper bottles has at least one vertical inner cylindrical guiding and constraining surface which coacts with said corresponding vertical guiding and constraining surface of said guides, wherein the coacting vertical guiding and constraining surfaces fit tightly together such that said carrier plate adheres to said cavity of each of said upper bottles so as to be lifted together with said upper bottles upon lifting said upper bottles.

16. The combination carrier plate and stack of bottles according to claim 15, wherein at least a part of a vertical guiding and constraining surface on the capsule (12) of each of said bottles in the underlying layer fits into the corresponding vertical guiding and constraining surface of said guides to achieve stable constrainment against lateral movement of the upper part of said bottle in the underlying layer; and wherein the vertical guiding and constraining surface of the cavity merges with a horizontal support surface which coacts with a corresponding support surface on said guides so that a weight of each bottle in the top layer is transferred to the corresponding bottle in the bottom layer via the support surfaces of the cavity and the capsule, respectively, without subjecting shoulders of the bottle in the bottom layer to any direct load.

17. The combination carrier plate and stack of bottles according to claim 16, wherein said fit of each of said bottles in the underlying layer into the corresponding vertical guiding and constraining surface of said guides is looser than said fit between said at least one vertical inner cylindrical guiding and constraining surface of said cavity of each of said upper bottles and said corresponding vertical guiding and constraining surface of said of said guides such that said carrier plate can be lifted without the underlying bottles being carried away.

18. The combination carrier plate and stack of bottles according to claim 15, wherein said fit between said at least one vertical inner cylindrical guiding and constraining surface of said cavity of each of said upper bottles and said corresponding vertical guiding and constraining surface of said guides is an interference fit.

19. The combination carrier plate and stack of bottles according to claim 15, wherein said fit between said at least one vertical inner cylindrical guiding and constraining surface of said cavity of each of said upper bottles and said corresponding vertical guiding and constraining surface of said guides is an snap fit.

20. The combination carrier plate and stack of bottles according to claim 14, wherein each of said guides further comprises a downwardly open, dome-shaped part to receive at least a part of the capsule of the corresponding lower bottle so as to constrain an upper part of said lower bottle against lateral movement; said dome-shaped part forming a cavity above said capsule of said corresponding lower bottle.

21. The combination carrier plate and stack of bottles according to claim 1, wherein said horizontal support surface (16) and said corresponding support surface (13) on said means for guiding and constraining said upper and lower bottles are ring-shaped so that the weight of said upper bottles is transferred to an outer-ring shaped portion on said capsule (12) of said lower bottles.

22. The combination carrier plate and stack of bottles according to claim 1, said carrier plate.

23. The combination carrier plate and stack of bottles according to claim 14, wherein each of said upper bottles snap-locks with said carrier plate.

* * * * *